US005996571A

United States Patent [19]

Jedick

[11] Patent Number: 5,996,571

[45] **Date of Patent: *Dec. 7, 1999**

[54] DIAMOND CORE DRILL BIT

[75] Inventor: Andrew L. Jedick, Avon Lake, Ohio

[73] Assignee: Diamond Products Joint Venture, Elyria, Ohio

[ * ] Notice: Under 35 U.S.C. 154(b), the term of this patent shall be extended for 8 days.

[21] Appl. No.: 08/595,498

[22] Filed: Feb. 1, 1996

[51] Int. Cl.[6] ..... B28D 1/02

[52] U.S. Cl. ..... 125/20; 451/540; 451/541

[58] Field of Search ..... 125/20; 451/544, 451/533, 541; 408/145, 204, 206, 207, 703; 175/403, 405, 426, 434

[56] References Cited

U.S. PATENT DOCUMENTS

| | | | |
|---|---|---|---|
| 2,543,861 | 3/1951 | Mader | 255/73 |
| 2,662,738 | 12/1953 | Davis et al. | 255/72 |
| 2,996,061 | 8/1961 | Miller | 125/20 |
| 3,113,626 | 12/1963 | Salisbury et al. . | |
| 3,412,813 | 11/1968 | Johnson . | |
| 3,464,655 | 9/1969 | Schuman . | |
| 3,537,538 | 11/1970 | Generoux | 175/330 |
| 3,736,995 | 6/1973 | Salter . | |
| 3,802,130 | 4/1974 | Lindenbeck | 451/544 |
| 4,208,154 | 6/1980 | Gundy | 125/20 |
| 4,711,609 | 12/1987 | Seefluth . | |
| 5,069,584 | 12/1991 | Obermeier et al. | 125/20 |
| 5,393,175 | 2/1995 | Courville . | |

OTHER PUBLICATIONS

Diamond Products, Inc. promotional brochure dated Jan. 1, 1988.

*Primary Examiner*—Derris H. Banks
*Attorney, Agent, or Firm*—Rankin, Hill, Porter & Clark LLP

[57] ABSTRACT

The present invention provides a hole saw or core drill bit for cutting annular holes in materials such as concrete, asphalt, masonry, rock, stone and related materials. The bit includes an elongated cylindrical body having a first end portion and a second end portion, a mounting platform at the first end of the body for attaching the bit to a driver and a cutting head at the second end of the body. The cutting head constitutes a plurality of cutting segments mounted on the annular face of the second end portion of the body. Each of the segments includes an outer portion, a middle portion and an inner portion. Each of the portions includes diamond particles dispersed throughout. The inner portions and the outer portions of the segments each have a greater concentration of diamond particles as compared to the middle portions. This dispersion of diamond particles provides a core drill bit with improved performance.

8 Claims, 1 Drawing Sheet

DIAMOND CORE DRILL BIT

TECHNICAL FIELD

The present invention concerns a diamond cutting tool. More particularly, the present invention concerns a new and improved diamond core drill bit or hole saw for cutting concrete, asphalt, rock, masonry and related materials.

BACKGROUND OF THE INVENTION

Diamond core drilling equipment is used extensively to drill circular or annular holes in a variety of material. Annular holes are formed in concrete, asphalt, rock and related materials for a variety of reasons. For example, holes are drilled in concrete for the purpose of correcting the settlement of pavement. Such settled concrete pavement is customarily restored to proper position by boring holes into the pavement and packing mud therethrough and beneath the pavement in order to raise and restore its level position. Further, for example, holes are also commonly drilled in concrete and similar materials so as to provide openings to utility conduit cells located beneath the surface of cast concrete floors of office and factory buildings. Further, for example, holes are also commonly drilled in concrete or masonry to facilitate the mounting of objects such as posts or pipes.

Generally speaking, diamond core drilling equipment comprises a motor-driven core drill assembly and a core drill bit or hole saw. The core drill assembly may embody various configurations, but such assembly generally comprises a base and a guide column extending up from the base. A carriage is provided between the column and the motor for guiding the motor along the column. Mounted to the motor is the drill bit. U.S. Pat. No. 3,464,655 to Schuman is an example of a prior art core drill assembly.

The prior art provides various types of core drill bits or hole saws. However, the majority of the commercial bits used today have cutting heads formed of a diamond impregnated material. More particularly, the cutting head comprises a plurality of cutting segments or teeth mounted at the distal end of the cylindrical body of the bit. Each of the segments includes a uniform concentration of diamond particles dispersed throughout the segments. Examples of prior art diamond core drill bits or hole saws are shown in a promotional brochure entitled "Laser Welded Dry Diamond Hole Saws For Brick And Block" distributed by Diamond Products of Elyria, Ohio, and dated Jan. 1, 1988.

SUMMARY OF THE INVENTION

The present invention provides a new and improved core drill bit or hole saw for cutting annular holes in concrete, masonry, rock, stone, asphalt and similar materials. The drill bit provides several distinct advantages over the bits of the prior art. More particularly, the present invention provides a drill bit that exhibits a truer cut, better tracking and a longer life as compared to prior art bits.

In one preferred embodiment the core drill bit comprises an elongated cylindrical body having a first end portion and an opposite second end portion. Included at the first end portion is a drive platform for facilitating the attachment of the bit to a drill assembly or other motor-driven drive mechanism. Included at the second end portion of the body is a cutting head. The cutting head includes a plurality of cutting segments mounted on the circular end face of the body. Each of the segments includes an outer portion, a middle portion and an inner portion all having diamond particles dispersed throughout. The inner portion and outer portion of each of the segments includes a greater concentration of diamond particles as compared to the middle portion of the cutting segments.

The foregoing and other features of the invention are hereinafter more fully described and particularly pointed out in the claims, the following description and drawings setting forth in detail certain illustrative embodiments of the invention, these being indicative, however, of but a few of the various ways in which the principles of the invention may be employed.

DETAILED DESCRIPTION

Figure 1:
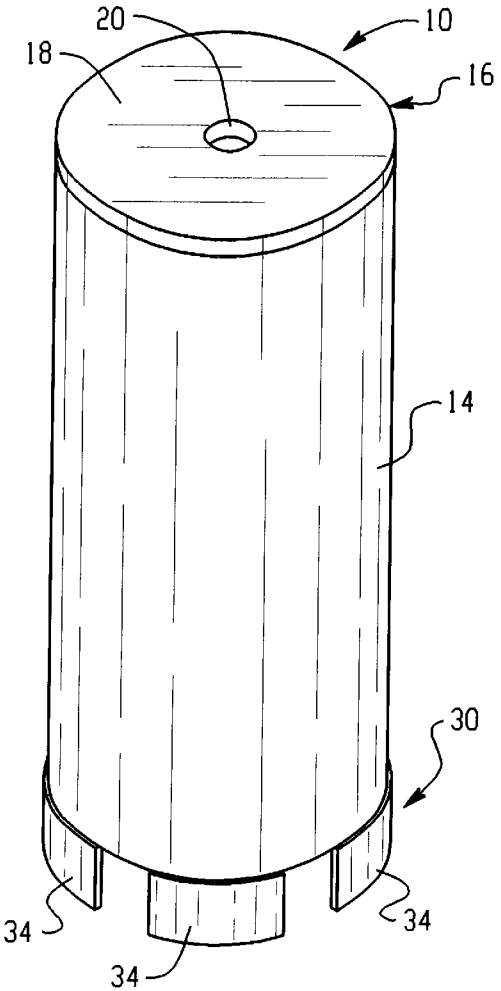
FIG. 1 is a perspective view of a core drill bit made in accordance with the present invention.
Figure 2:
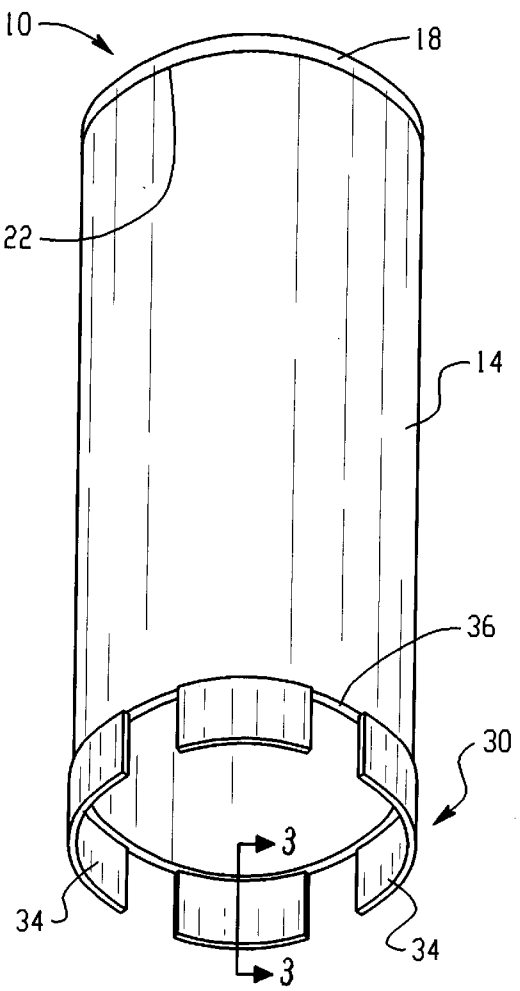
FIG. 2 is another perspective view of the core drill bit of FIG. 1.

Referring to the drawings, and initially to FIG. 1 and FIG. 2, there is shown a core drill bit or hole saw 10 made in accordance with the present invention. The bit 10 includes a cylindrical or tubular steel body 14. Provided at one end of the body 14 is a mounting platform 16 that comprises a circular metal disk 18 having a circular hole 20 extending through the center thereof. Disk 18 is mounted, for example, by welding to the annular end face 22 of the body 14. Mounting platform 16 serves to facilitate the attachment of the bit to a drill assembly or other motor-driven piece of equipment. It will be appreciated that mounting platform 16 may have any one of a variety of configurations to facilitate the mounting of a bit to a driver. For example, mounting platform 16 may include a threaded nut or similar fastener mounted to the circular disk 18 to receive a wrench for aid in attaching the bit to a driver.

Located at the end of the body 14 opposite to the mounting platform 16 is a cutting head 30. Cutting head 30 comprises a plurality of cutting segments 34 mounted to the end face 36 of the body 14. As with a conventional bit, segments 34 are slightly wider than the body 14 so as to provide sufficient clearance for the body during cutting operations.

Figure 3:
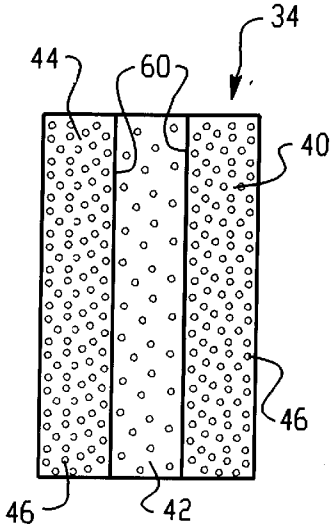
FIG. 3 is a broken-away cross sectional view of the cutting segment alone of the core drill bit of FIG. 2 taken along line 3—3 thereof.

Referring now also to FIG. 3, each of the segments 34 includes an outer portion 40, a middle portion 42 and an inner portion 44. Each of these portions represents about a third of the volume of the segment and each of these portions includes diamond particles 46 dispersed throughout. However, the inner portion 44 and the outer portion 40 have a greater concentration or percentage of diamond particles as compared to the middle portion 42.

More particularly, the segments 34 preferably include a dispersion of diamonds with a particle size of between about 40/50 US Mesh and about 30/40 US Mesh. This designates a diamond particle size such that about 460 to about 1300 of such particles are equivalent to one carat. The dispersion of diamonds in the various portions is such that each of the inner portions 44 and the outer portions 40 contain between about 20% and about 40% by weight more diamond particles as compared to the middle portions 42.

The segments 34 may be produced in a conventional manner using care to increase the percentage of diamond particles in the inner portions 44 and the outer portions 40. More particularly, the diamond particles 46 are first mixed or dispersed into metal powder, such as, for example, a conventional cobalt-iron-bronze alloy powder. Tungsten carbide and other cutting materials may also be added to the mixture. A different mixture is prepared for the middle portion 42 as compared to the inner portion 44 and the outer portion 40 so as to provide the greater concentration of diamonds in the inner and outer portions. The mixtures are then placed in a graphite mold so as to form the different concentrations of diamond particles. The mixture is then pressed and fired to form the segments 34. The segments 34 are then attached to the annular face of the body 14 by using any one of a variety of conventional techniques such as, for example, laser welding.

The core drill bits of the present invention exhibit truer cuts, better tracking and a longer life as compared to conventional bits which have a uniform dispersion of diamonds throughout the segments.

It will be appreciated that although in FIG. 3 lines (indicated generally at 60) are shown to distinguish the inner 44, middle 42 and outer portions 40, in reality, such portions are structurally continuous and such portions can only be distinguished by their differential concentration of diamond particles. Also, it will be appreciated that the body 14 of the bit 10 may exhibit various diameters and lengths depending upon the size of the desired hole. Further, it will be appreciated that any number of segments 34 may be employed and the configuration of the segments 34 may be altered. For example, the segments 34 may have a greater width, length or height than that shown in the annexed drawings.

While the invention has been shown and described with respect to specific embodiments thereof, this is intended for the purpose of illustration rather than limitation, and other variations and modifications of the specific devices herein shown and described will be apparent to those skilled in the art all within the spirit and scope of the present invention. Accordingly, this patent is not to be limited in scope and effect to the specific embodiments herein shown and described nor in any other way that is inconsistent with the extent to which the progress in the art has been advanced by the invention.

What is claimed:

1. A core drill bit for cutting annular holes in materials such as concrete comprising an elongated cylindrical body having a first end section and an opposed second end section having an annular end face, a mounting platform at the first end of said body for attaching the bit to a driver and a cutting head at the second end of said body, the cutting head comprises a plurality of cutting segments mounted on the annular end face of said second end of said body, each of said segments including an outer portion, a middle portion and an inner portion, said inner portion, said middle portion and said outer portion all having diamond particles dispersed throughout each of said portions, said inner portions and said outer portions having a greater concentration of diamond particles as compared to said middle portions.

2. A drill bit as set forth in claim 1 wherein said inner portions, said outer portions and said middle portions of said segments each comprise about one-third of a total volume of each of said segments.

3. A drill bit as set forth in claim 2 wherein said inner portions and said outer portions of said segments each include at least a 20% by weight greater concentration of diamond particles as compared to said middle portions.

4. A drill bit as set forth in claim 2 wherein said inner portions and said outer portions of said segments each include at least from between about 20% to about 40% by weight of a greater concentration of diamond particles as compared to said middle portions.

5. A drill bit as set forth in claim 1 wherein said diamond particles comprise a particle size of from between 40/50 US Mesh and 30/40 US Mesh.

6. A drill bit as set forth in claim 1 wherein said mounting platform comprises a metal disk mounted at the first end of said body.

7. A drill bit as set forth in claim 6 wherein said metal disk includes a circular opening extending therethrough.

8. A drill bit as set forth in claim 1 wherein said segments are laser welded to the end face of said body.

* * * * *